US009840400B2

(12) United States Patent
Tsai et al.

(10) Patent No.: US 9,840,400 B2
(45) Date of Patent: Dec. 12, 2017

(54) STERILIZATION AND CLEANING SYSTEM OF ESCALATOR

(71) Applicant: Ling-Chen Lee, Taoyuan (TW)

(72) Inventors: I-Chieh Tsai, Taoyuan (TW); Chien-Yu Lee, Taoyuan (TW); Ling-Chen Lee, Taoyuan (TW); Ting-Ting Lee, Taoyuan (TW)

(73) Assignee: Ling-Chen Lee, Taoyuan (TW)

( * ) Notice: Subject to any disclaimer, the term of this patent is extended or adjusted under 35 U.S.C. 154(b) by 187 days.

(21) Appl. No.: 15/044,107

(22) Filed: Feb. 16, 2016

(65) Prior Publication Data

US 2016/0236912 A1 Aug. 18, 2016

(30) Foreign Application Priority Data

Feb. 16, 2015 (TW) ..... 104105292 A

(51) Int. Cl.
*B66B 31/02* (2006.01)

(52) U.S. Cl.
CPC ..... *B66B 31/02* (2013.01)

(58) Field of Classification Search
CPC ..... B66B 31/02
See application file for complete search history.

(56) References Cited

U.S. PATENT DOCUMENTS

| | | | | |
|---|---|---|---|---|
| 2005/0091780 | A1 | 5/2005 | Schulz | |
| 2012/0273003 | A1* | 11/2012 | Holloway | A61L 2/16 134/6 |
| 2015/0028228 | A1 | 1/2015 | Almasy et al. | |

FOREIGN PATENT DOCUMENTS

| | | |
|---|---|---|
| CN | 102442605 | 5/2012 |
| CN | 103764536 | 4/2014 |
| JP | H08165085 | 6/1996 |
| JP | 2007314298 | 12/2007 |
| JP | 2008222324 | 9/2008 |
| TW | M263344 | 5/2005 |
| TW | 201233618 | 8/2012 |
| TW | M445010 | 1/2013 |
| TW | M494783 | 2/2015 |

OTHER PUBLICATIONS

"Office Action of China Counterpart Application," dated Apr. 13, 2017, p. 1-p. 7.
"Office Action of Taiwan Counterpart Application", dated Jun. 6, 2016, p. 1-p. 3.

* cited by examiner

*Primary Examiner* — Jason Ko
(74) *Attorney, Agent, or Firm* — JCIPRNET

(57) ABSTRACT

A sterilization and cleaning system of an escalator including a first body, a counting wheel, a controller, a second body and a cloud sever is provided. The first body includes a first tank and a first atomizer connected to the first tank. The first atomizer is adapted to atomize a first sterilization and cleaning liquid and spray the atomized first sterilization and cleaning liquid to a handrail of an escalator. The counting wheel is pivoted to the first body. The controller is electrically coupled to the first atomizer. The second body is disposed side by side with the first body, wherein the second body includes a projector, a sensor and a wireless transmission module. The projector and the sensor are electrically coupled to the controller. The wireless transmission module is electrically coupled to the controller and the sensor. The cloud sever is adapted to communicate with the wireless transmission module.

22 Claims, 10 Drawing Sheets

STERILIZATION AND CLEANING SYSTEM OF ESCALATOR

CROSS-REFERENCE TO RELATED APPLICATION

This application claims the priority benefit of Taiwan application serial no. 104105292, filed on Feb. 16, 2015. The entirety of the above-mentioned patent application is hereby incorporated by reference herein and made a part of this specification.

BACKGROUND OF THE INVENTION

1. Field of the Invention

The invention relates to a sterilization and cleaning system, and particularly relates to a sterilization and cleaning system of an escalator.

2. Description of Related Art

Escalators are commonly used in shopping malls, hypermarkets, department stores, and other public areas to take the users to different floors. Generally speaking, the users usually hold the handrail of the escalator or lean against the handrail of the escalator with their arms, so as to prevent themselves from falling down when taking the escalator. After being used for a certain period of time, the handrail of the escalator may become dirty, and there may be genus on the handrails. Thus, when the users hold or lean against the handrail of the escalator with their hands or arms, users' hands or anus may carry the dirt and germs. Conventionally, the handrail of the escalator is cleaned manually, and is normally cleaned and sterilized when there are fewer people in the public areas or when the public areas are closed. Thus, the effect of cleaning and sterilization is not preferable.

Thus, how to develop a system that automatically and regularly sterilizes and cleans the handrail of the escalator becomes an issue to work on. In the meantime, since there are many people in the public areas, how to incorporate the concept of the Internet of Things into the sterilization and cleaning system, so as to control the sterilization and cleaning system, calculate and control the traffic of people, or transmit and broadcast messages in the form of video, text, or image in addition to automatically cleaning and sterilizing the handrail of the escalator, thereby creating a more significant business effect, has become an issue for future development.

SUMMARY OF THE INVENTION

The invention provides a sterilization and cleaning system of an escalator not only capable of automatically sterilizing and cleaning a handrail of an escalator, but also capable of controlling the sterilization and cleaning system, calculating and controlling the traffic of people, or transmitting or displaying information in the form of video, text, or image through a cloud server.

The invention provides a sterilization and cleaning system of an escalator, including a first body, a counting wheel, a controller, a second body, and a cloud server. The first body includes a first tank and a first atomizer. The first tank stores a first sterilization and cleaning liquid. The first atomizer is connected to the first tank and adapted to atomize the first sterilization and cleaning liquid in the first tank and spray the atomized first sterilization and cleaning liquid to a handrail of the escalator. The counting wheel is pivoted on the first body and abuts against the handrail, so as to synchronously rotate as the handrail operates. The controller is electrically coupled to the first atomizer. The second body is disposed side by side with the first body and includes a projector, a sensor, and a wireless transmission module. The projector is electrically coupled to the controller. The sensor is electrically coupled to the controller and faces a passage of the escalator to sense a person passing through the passage. The wireless transmission module is electrically coupled to the controller and the sensor. The cloud server is adapted to communicate with the wireless transmission module.

According to an embodiment of the invention, the first tank has an opening and a bottom opposite to the opening. The first atomizer includes an atomizing nozzle and an absorber connected to the atomizing nozzle. The atomizing nozzle is disposed at the opening and electrically coupled to the controller. The absorber extends from the opening toward the bottom to provide the first sterilization and cleaning liquid to the atomizing nozzle.

According to an embodiment of the invention, the first body further includes a level monitor. The level monitor is electrically coupled to the controller to monitor a liquid level of the first sterilization and cleaning liquid in the first tank.

According to an embodiment of the invention, when the level monitor detects that the liquid level is lower than a predetermined value, the controller stops the first atomizer from atomizing the first sterilization and cleaning liquid and sends a warning signal to the cloud server.

According to an embodiment of the invention, the counting wheel includes a shaft rod, a wheel, and a counter. The shaft rod is pivoted on the first body. The wheel is sleeved on the shaft rod and abuts against the handrail, so as to synchronously rotate as the handrail operates. The counter is electrically coupled to the controller. In addition, the counter is disposed corresponding to the wheel to calculate an operation distance of the handrail.

According to an embodiment of the invention, the counter is adapted to transmit the operation distance of the handrail to the controller, such that the controller controls a period that the first atomizer atomizes the first sterilization and cleaning liquid and sprays the atomized first sterilization and cleaning liquid to the handrail of the escalator based on the operation distance.

According to an embodiment of the invention, the sensor is adapted to transmit the number of the person passing through the passage to the controller, such that the controller controls a period that the first atomizer atomizes the first sterilization and cleaning liquid and sprays the atomized first sterilization and cleaning liquid to the handrail of the escalator based on the number of the person passing through the passage.

According to an embodiment of the invention, the sensor is adapted to transmit the number of the person passing through the passage to the cloud server through the wireless transmission module.

According to an embodiment of the invention, the sensor is adapted to notify the cloud server through the wireless transmission module when sensing that the person passes through the passage, such that the cloud server pushes a message to a mobile device of the person passing through the passage through the wireless transmission module.

According to an embodiment of the invention, after the wireless transmission module establishes connection with a mobile device of the person passing through the passage, the cloud server is adapted to push a message to the mobile device of the person passing through the passage through the wireless transmission module.

According to an embodiment of the invention, the cloud server is adapted to transmit digital information to the wireless transmission module and the digital information is transmitted to the controller by the wireless transmission module, such that the controller controls projection of the projector based on the digital information.

According to an embodiment of the invention, a transmission of the wireless transmission module includes infrared transmission, radio transmission, bluetooth transmission, or wireless fidelity transmission.

According to an embodiment of the invention, the sterilization and cleaning system of the escalator further includes a power supply module. The power supply module is detachably disposed between the first body and the second body and adapted to provide power to the first body, the controller, and the second body.

According to an embodiment of the invention, the sterilization and cleaning system of the escalator further includes a display module disposed side by side with the first body and the second body. The display module includes a frame body and a display. The frame body has a base, a top plate opposite to the base, and a sliding track between the base and the top plate. The display is slidably disposed in the sliding track, and electrically coupled to the controller. The cloud server is adapted to transmit digital information to the wireless transmission module and the digital information is transmitted to the controller by the wireless transmission module, such that the controller controls an image displayed on the display based on the digital information.

According to an embodiment of the invention, the display module further includes a second atomizer. The second atomizer is disposed in a chamber of the top plate and electrically coupled to the controller. The frame body further includes a second tank located at the base and storing a second sterilization and cleaning liquid and a pipe connecting the chamber and the second tank. In addition, the pipe is connected to the second atomizer and adapted to provide the second sterilization and cleaning liquid to the second atomizer, such that the atomized second sterilization and cleaning liquid is sprayed to an external environment via a plurality of openings connected with the chamber after the second atomizer atomizes the second sterilization and cleaning liquid.

According to an embodiment of the invention, the counter is adapted to transmit the operation distance of the handrail to the controller, such that the controller controls a period that the second atomizer atomizes the second sterilization and cleaning liquid and sprays the atomized second sterilization and cleaning liquid to the external environment via the openings based on the operation distance.

According to an embodiment of the invention, the sensor is adapted to transmit the number of the person passing through the passage to the controller, such that the controller controls a period that the second atomizer atomizes the second sterilization and cleaning liquid and sprays the atomized second sterilization and cleaning liquid to the external environment via the openings based on the number of the person passing through the passage.

According to an embodiment of the invention, the display module further includes at least one solar energy panel disposed at the top plate of the frame body.

According to an embodiment of the invention, the sterilization and cleaning system of the escalator further includes a display module disposed side by side with the first body and the second body. The display module includes a frame body, a base, and a display. The frame body is inserted into or pivoted to the base. The frame body has a top part opposite to the base. The display, having a pivot part, and the display is pivoted to the top part by using the pivot part for rotating with respect to the frame body. The display is electrically coupled to the controller, and the cloud server is adapted to transmit digital information to the wireless transmission module and the digital information is transmitted to the controller by the wireless transmission module, such that the controller controls an image displayed on the display based on the digital information.

According to an embodiment of the invention, the first body, the counting wheel, and the second body are embedded in a transport base of the escalator.

According to an embodiment of the invention, the controller is embedded in a transport base of the escalator.

Based on above, the embodiments of the invention provide the sterilization and cleaning system of the escalator including the first body, the counting wheel, the controller, the second body, and the cloud server. The cloud server is adapted to communicate with the wireless transmission module in the second body for two-way data transmission. More specifically, the first atomizer is disposed in the first body, and the controller controls the first atomizer to atomize the first sterilization and cleaning liquid in the first tank, such that the atomized first sterilization and cleaning liquid is sprayed to the handrail of the escalator, thereby automatically sterilizing and cleaning the handrail of the escalator. Furthermore, the cloud server is adapted to transmit digital information to the wireless transmission module, and the digital information is transmitted to the controller by the wireless transmission module, so that the controller may control the projection of the projector of the second body based on the digital information. For example, the projector may project relevant advertisement information or public information in the form of video, image, or text, for example, to the ground near the entrance or the exit of the passage of the escalator or to a wall, a ceiling, a projection billboard correspondingly disposed for people to view.

Moreover, the sensor also transmits the number of the person passing through the passage to the cloud server through the wireless transmission module for controlling and calculating the traffic of people. When the sensor senses that the person passes through the passage of the escalator, the sensor may notify the cloud server through the wireless transmission module, such that the cloud server may push a message to a portable system (e.g., a smartphone or a tablet computer) of the person passing through the passage through the wireless transmission module for the person to view. For example, the message may be advertisement information or public information, and the control and calculation of the traffic of people may serve as an evaluation on an effect of the advertisement or propaganda.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF THE EMBODIMENTS

Figure 1:
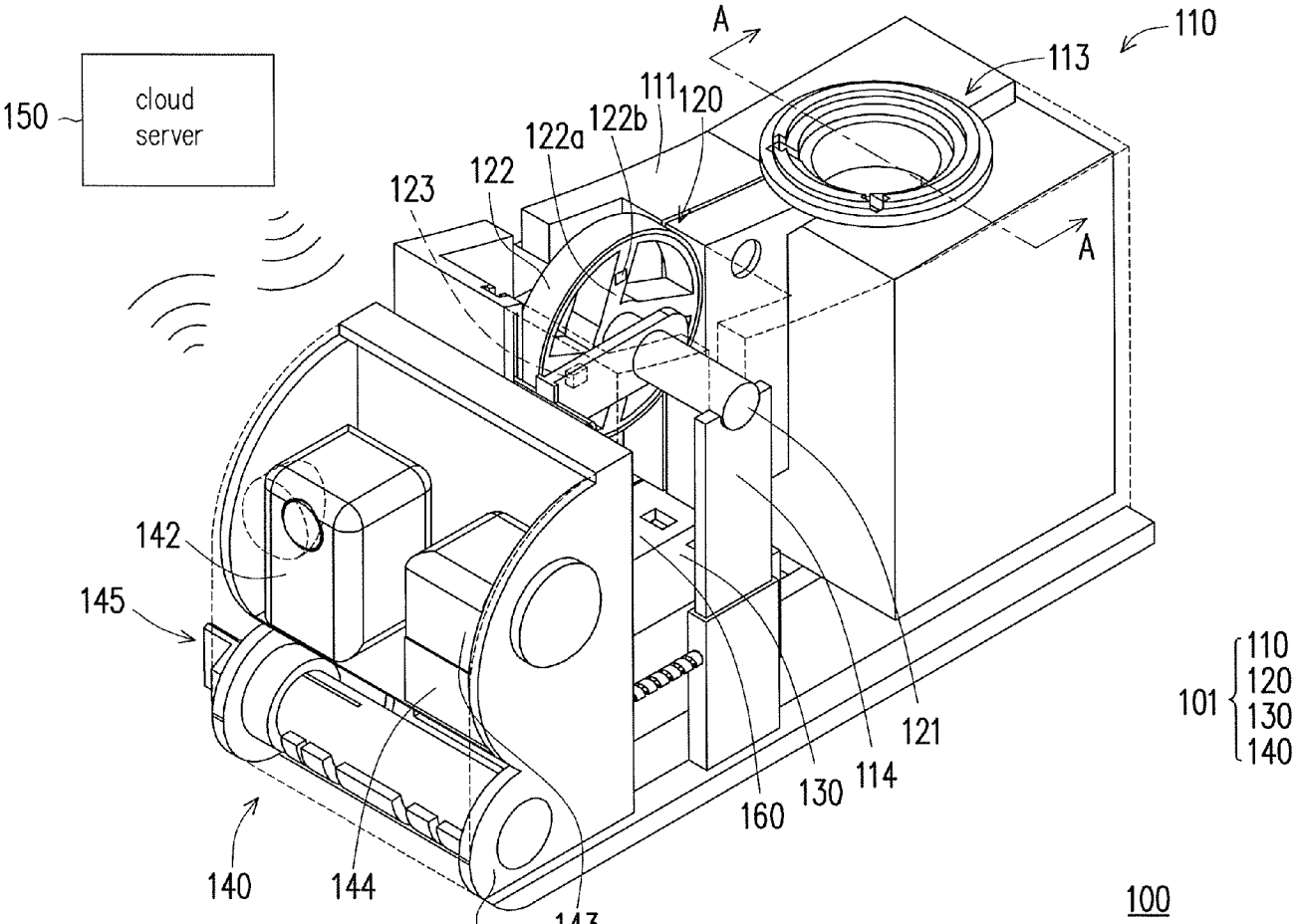
FIG. 1 is a schematic view illustrating a sterilization and cleaning system of an escalator according an embodiment of the invention.

Reference will now be made in detail to the embodiments of the disclosure, examples of which are illustrated in the accompanying drawings. Wherever possible, the same reference numbers are used in the drawings and the description to refer to the same or like parts.

Figure 2:
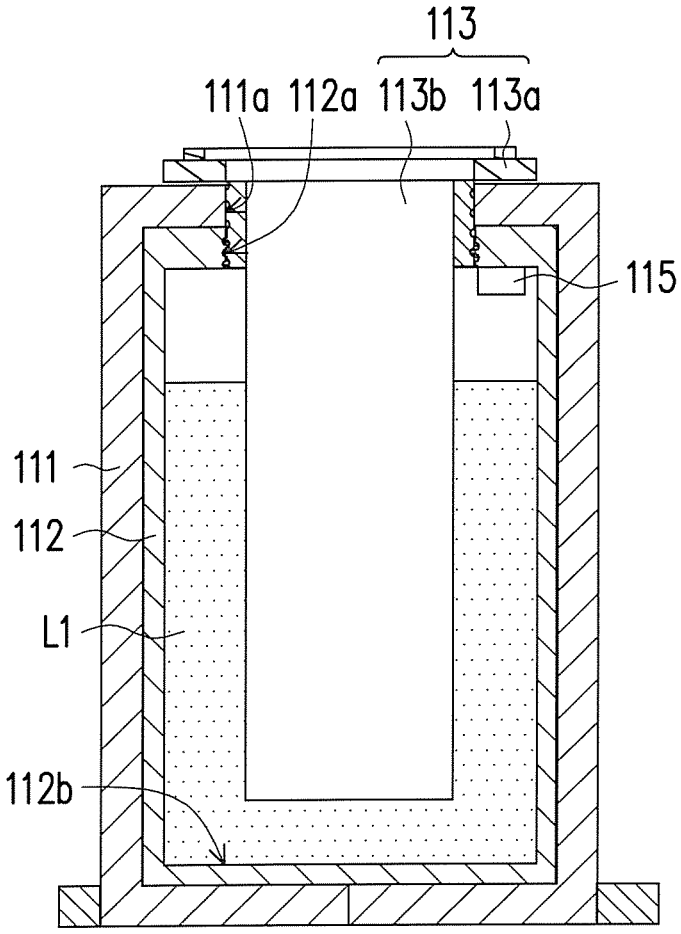
FIG. 2 is a schematic cross-sectional view of a first body shown in FIG. 1 along a cross-sectional line A-A.
Figure 3:
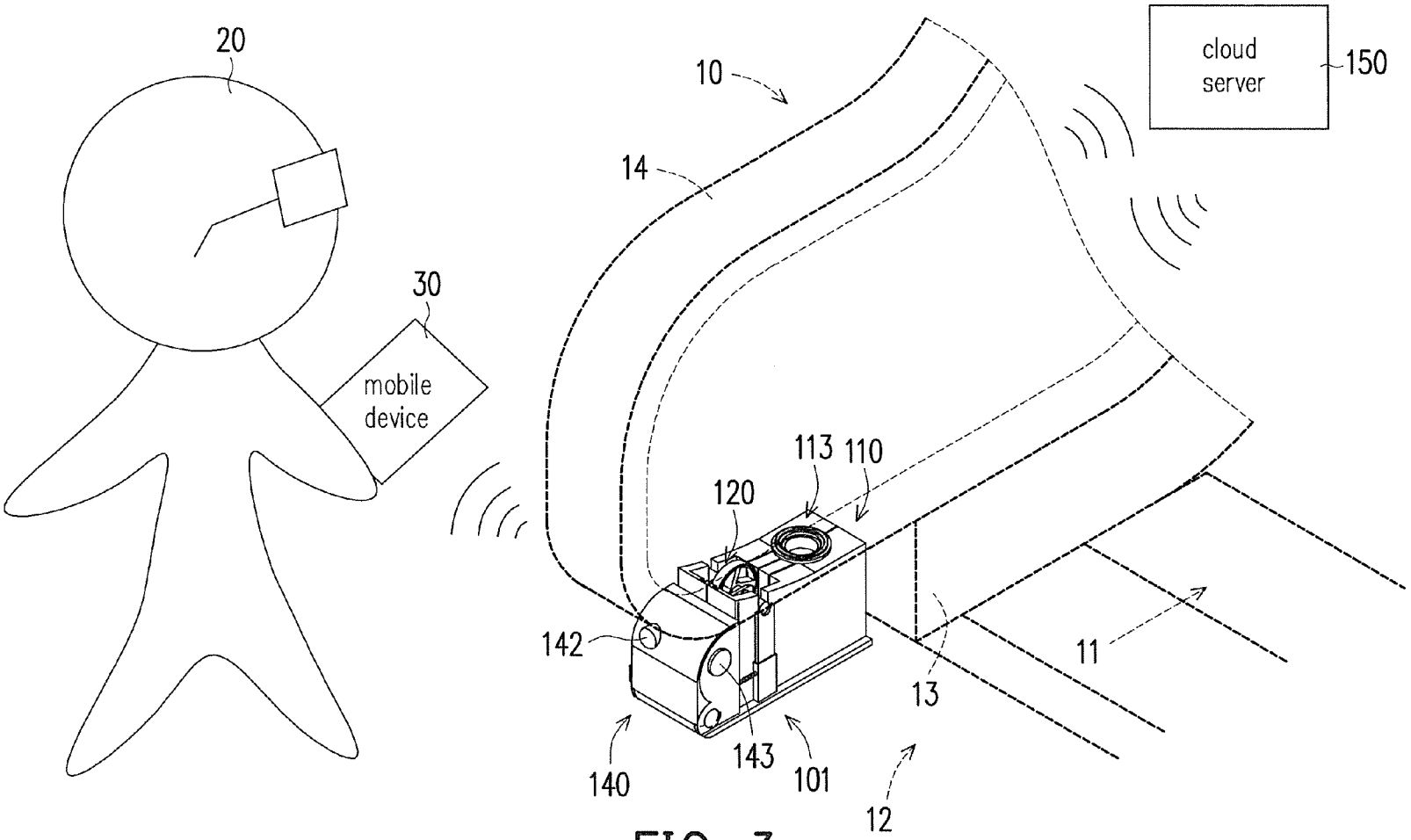
FIG. 3 is a schematic view illustrating the sterilization and cleaning system of the escalator of FIG. 1 being mounted in an escalator.
Figure 4:
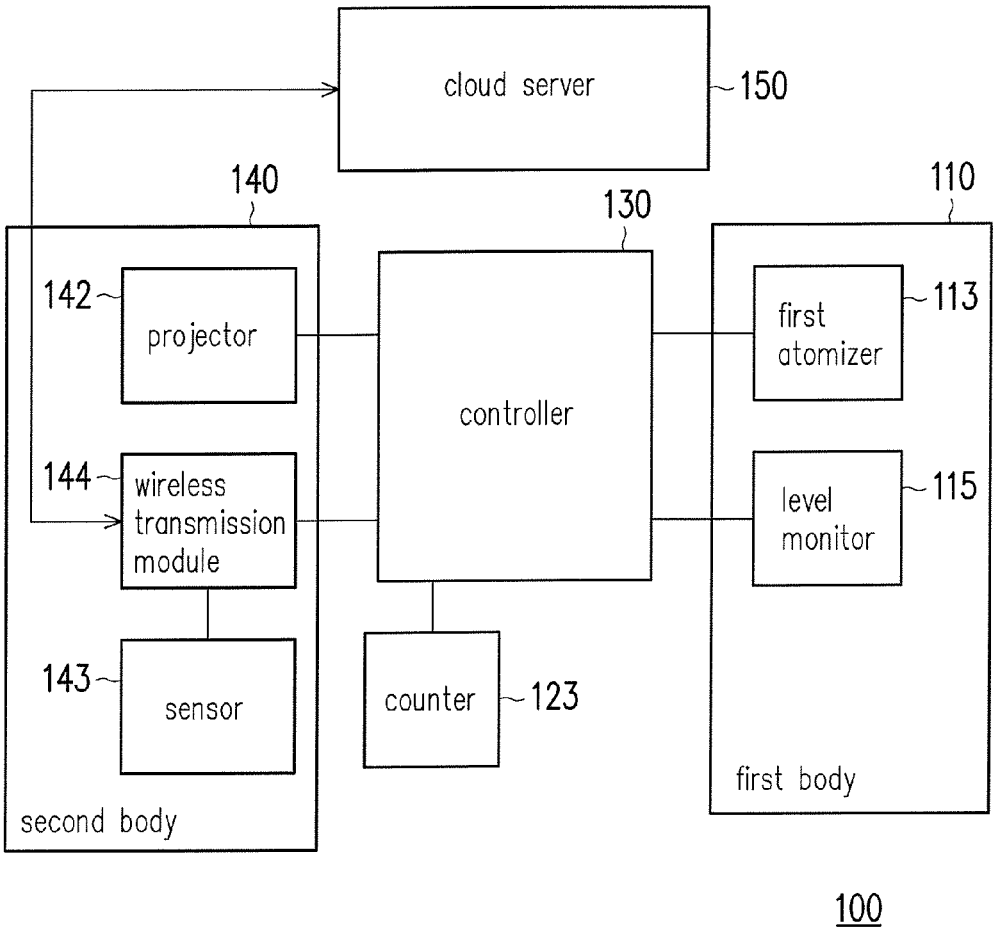
FIG. 4 is a schematic view illustrating connections of the sterilization and cleaning system of the escalator of FIG. 1.

FIG. 1 is a schematic view illustrating a sterilization and cleaning system of an escalator according an embodiment of the invention. FIG. 2 is a schematic cross-sectional view of a first body shown in FIG. 1 along a cross-sectional line A-A. FIG. 3 is a schematic view illustrating the sterilization and cleaning system of the escalator of FIG. 1 being mounted in an escalator. FIG. 4 is a schematic view illustrating connections of the sterilization and cleaning system of the escalator of FIG. 1. Referring to FIGS. 1 to 4, in this embodiment, a sterilization and cleaning system 100 of an escalator includes a first body 110, a counting wheel 120, a controller 130, a second body 140, and a cloud server 150. The first body 110, the counting wheel 120, the controller 130, and the second body 140 form a main apparatus 101, for example. The main apparatus 101 is adapted to be installed at an entrance 12 or an exit (not shown) of a passage 11 of an escalator 10, and is disposed at a lower end of the escalator 10, for example. However, the invention is not limited thereto. In another embodiment, the main apparatus 101 formed by the first body 110, the counting wheel 120, the controller 130, and the second body 140 may also be embedded in a transport base 13 of the escalator 10. In yet another embodiment, only the first body 110, the counting wheel 120, and the second body 140 are embedded in the transport base 13 of the escalator 10, and the controller 130 may be externally disposed at the transport base 13, for example.

The first body 110 is mainly adapted for cleaning and sterilization, and includes a case 111, a first tank 112, and a first atomizer 113. The case 111 has an opening 111*a*. The first tank 112 is located in the case 111. In addition, the opening 111*a* is aligned with an opening 112*a* of the first tank 112, and the first tank 112 stores a first sterilization and cleaning liquid L1. The first atomizer 113 is connected to the first tank 112. In addition, the first atomizer 113 may include an atomizing nozzle 113*a* and an absorber 113*b* connected to the atomizing nozzle 113*a*. The atomizing nozzle 113*a* is an ultrasonic atomizing nozzle, for example, and the absorber 113*b* is an absorbing sponge, for example. Specifically, the atomizing nozzle 113*a* is disposed at the openings 111*a* and 112*a*, and electrically coupled to the controller 130. Besides, the absorber 113*b* extends from the opening 112*a* toward a bottom 112*b* of the first tank 112, so as to provide the first sterilization and cleaning liquid L1 to the atomizing nozzle 113*a*. In addition, the opening 112*a* and the bottom 112*b* are opposite to each other. The controller 130 is adapted to provide a control signal to the atomizing nozzle 113*a*, such that the atomizing nozzle 113*a* starts atomizing the first sterilization and cleaning liquid L1 provided by the absorber 113*b* and spraying the atomized first sterilization and cleaning liquid L1 to a handrail 14 of the escalator 10. In other words, the atomizing nozzle 113*a* is disposed corresponding to the handrail 14 of the escalator 10, so as to effectively perform a sterilization and cleaning operation.

In another embodiment, the first atomizer 113 may also be formed by only an ultrasonic nozzle. Under this circumstance, the ultrasonic nozzle may directly contact the first sterilization and cleaning liquid L1. Thus, the first sterilization and cleaning liquid L1 may still be atomized to be sprayed to the handrail 14 without using the absorber 113*b* to provide the first sterilization and cleaning liquid L1. In addition, to verify whether the first atomizer 113 functions normally (i.e., atomizing the first sterilization and cleaning liquid L1 and spraying the atomized first sterilization and cleaning liquid L1 to the handrail 14), a humidity sensor may be optionally disposed near the atomizing nozzle 113*a*. The humidity sensor is located between the atomizing nozzle 113*a* and the handrail 14, for example, to sense a humidity state around the atomizing nozzle 113*a*.

The counting wheel 120 is pivoted on the case 111 of the first body 110, and abuts against the handrail 14, so as to synchronously rotate as the handrail 14 operates. More specifically, the counting wheel 120 includes a shaft rod 121, a wheel 122, and a counter 123. One end of the shaft rod 121 is pivoted on the case 111 of the first body 110, and the other end of the shaft rod 121 is pivoted on a pivot base 114. The wheel 122 is sleeved on the shaft rod 121 (or the shaft rod 121 passes through the wheel 122) and abuts against the handrail 14. Thus, when the handrail 14 operates, the wheel 122 may synchronously rotate with the handrail 14 through the shaft rod 121. The counter 123 is an optoelectronic sensor, for example, and electrically coupled to the controller 130. In addition, the counter 123 is disposed corresponding to the wheel 122, and a sensor tab 122*b* is attached to a spoke 122*a* of the wheel 122. In other words, the counter 123 calculates the number of turns that the wheel 122 rotates based on the number that the spoke 122*a* where the sensor tab 122*b* is attached passes, so as to derive an operation distance of the handrail.

The calculator 123 is adapted to transmit the operation distance of the handrail 14 to the controller 130, such that the controller 130 may control a period that the first atomizer 113 to atomize the first sterilization and cleaning liquid L1 and spray the atomized first sterilization and cleaning liquid L1 to the handrail 14 of the escalator 10 based on the operation distance. In other words, spraying of the atomized first sterilization and cleaning liquid L1 is not continuous without interruption. Instead, after each spraying (lasting several minutes, for example), the controller 130 may transmit a stop signal to the first atomizer 113, such that the first atomizer 113 may temporarily stop atomizing the first sterilization and cleaning liquid L1. Then, after the first atomizer 113 stops spraying the atomized first sterilization and cleaning liquid L1 and the operation distance calculated by the counter 123 reaches a predetermined value, the controller 130 may send a start signal to the first atomizer 113, such that the first atomizer 113 may perform the operation of atomizing the first sterilization and cleaning liquid L1 and spraying the atomized first sterilization and cleaning liquid L1 to the handrail 14 of the escalator 10 again. In other embodiments, the calculator 123 may also include a control unit electrically coupled to the first atomizer 113. Under such circumstance, the counter 123 may control the period that the first atomizer 113 atomizes the first sterilization and cleaning liquid L1 based on the operation distance of the handrail 14 by using the control unit.

The second body 140 and the first body 110 are disposed side by side, and the controller 130 is disposed between the second body 140 and the first body 110, for example. In this embodiment, the second body 140 includes a case 141, a projector 142, a sensor 143, and a wireless transmission module 144. In addition, the projector 142, the sensor 143, and the wireless transmission module 144 are disposed in the case 141. The projector 142 and the sensor 143 are electrically coupled to the controller 130, and the wireless transmission module 144 is electrically coupled to the controller 130 and the sensor 143. Also, the cloud server 150 is adapted to communicate with the wireless transmission module 144 for two-way data transmission.

More specifically, the cloud server 150 is adapted to transmit digital information to the wireless transmission module 144, and the digital information is transmitted to the controller 130 by the wireless transmission module 144, such that the controller 130 may control projection of the projector 142 based on the digital information. For example, the projector 142 may project relevant advertisement information or public information in the foam of video, image, or text, for example, to a ground near the entrance 12 or the exit (not shown) of the passage 11 of the escalator 10 for a person 20 passing through the passage 11 of the escalator 10 to view. However, the invention is not limited thereto. In another embodiment, the projector 142 may also project the relevant advertisement information or public information to a wall, a ceiling, a projection billboard correspondingly disposed, or other suitable positions in the environment. In yet another embodiment, the projector 142 may be a naked-eye three-dimensional projector to project the relevant advertisement information or public information in a space in the form of video, image, or text, for example. Moreover, the invention is not limited to an embodiment where the projector 142 is disposed in the case 141. It is also possible to implement by externally disposing the projector 142 at the second body 140.

Moreover, the sensor 143 may be an infrared sensor, a laser sensor, or other suitable optoelectronic sensors, for example. The sensor 143 faces the passage 11 of the escalator 10 to sense the person 20 passing through the passage 11. For example, the sensor 143 is adapted to transmit the number of the person 20 passing through the passage 11 to the controller 130, such that the controller 130 may control the period that the first atomizer 113 atomizes the first sterilization and cleaning liquid L1 and sprays the atomized first sterilization and cleaning liquid L1 to the handrail 14 of the escalator 10 based on the number of the person 20 passing through the passage 11. In other words, spraying of the atomized first sterilization and cleaning liquid L1 is not continuous without interruption. Instead, after each spraying (lasting several minutes, for example), the controller 130 may transmit a stop signal to the first atomizer 113, such that the first atomizer 113 may temporarily stop atomizing the first sterilization and cleaning liquid L1. Then, after spraying of the atomized first sterilization and cleaning liquid L1 is stopped, and the sensor 143 senses that the number of the person 20 passing through the passage 11 reaches the predetermined value, the controller 130 may send a start signal to the first atomizer 113, such that the first atomizer 113 may perform the operation of atomizing the first sterilization and cleaning liquid L1 and spraying the first atomized sterilization and cleaning liquid L1 to the handrail 14 of the escalator 10 again.

It should be noted that the operation that the first atomizer 113 atomizes the first sterilization and cleaning liquid may be accomplished by sending a control signal from the cloud server to the controller 130 for the controller 130 to control the first atomizer 113 based on the control signal. Alternatively, the cloud server may directly send a control signal to control the first atomizer 113 without using the controller 130.

Meanwhile, the sensor 143 also transmits the number of the person 20 passing through the passage 11 to the cloud server 150 through the wireless transmission module 144 for controlling and calculating the traffic of people. Also, when the sensor 143 senses that the person 20 passes through the passage 11, the sensor 143 may notify the cloud server 150 through the wireless transmission module 144, such that the cloud server 150 may push a message through the wireless transmission module 144 to a mobile device 30 (e.g., a smartphone or a tablet computer) of the person 20 passing through the passage 11 for the person 20 to view. For example, the message may be advertisement information or public information, and the control and calculation of the traffic of people may serve as an evaluation on an effect of the advertisement or propaganda. In general, the transmission of the wireless transmission module 144 may include infrared transmission, radio transmission, bluetooth (e.g., low-power bluetooth) transmission, or wireless fidelity (Wi-Fi) transmission. Alternatively, a wireless mobile communication unit (e.g., a GSM, GPRS, 3G, or 4G system) may be used for communication and transmission. It should be understood that the invention does not intend to impose a limitation in this regard.

In another embodiment, a wireless transmission module (not shown) of the mobile device 30 of the person 20 passing through the passage 11 is adapted to establish connection with the wireless transmission module 144 within a predetermined distance. After the wireless transmission module (not shown) of the mobile device 30 is matched and connected with the wireless transmission module 144, the cloud server 150 may push a message to the mobile device 30. Here, the message may be pushed through the following mechanisms. First, a network app may be installed in the mobile device 30, and after the wireless transmission module (not shown) of the mobile device 30 is matched and connected to the wireless transmission module 144, the network app may send a request signal to the wireless transmission module 144. When receiving the request signal, the wireless transmission module 144 may return physical location digital information to the network app. Then, the network app may connect with the cloud server 150 and transmit corresponding digital contents to the network app to be displayed based on the physical location digital information. Second, a network app may be installed in the mobile device 30, and after the wireless transmission module (not shown) of the mobile device 30 is matched and connected to the wireless transmission module 144, the wireless transmission module 144 may send a request signal to the cloud server 150. When receiving the request signal, the cloud server 150 may send connection location information to the mobile device 30. Then, the network app may send another request signal to the cloud server 150, such that the cloud server 150 may transmit digital contents to the mobile device 30 to be displayed based on the connection location information.

It should be noted that even though the wireless transmission module 144 is disposed in the second body 140 is this embodiment as an example, the invention is not limited thereto. For example, the wireless transmission module may also be disposed in the first body 110 so as to communicate with the cloud server 150.

In this embodiment, the first body 110 further includes a level monitor 115 located in the first tank 112 and, for example, at a position relatively closer to a side where the opening 112*a* is located. In other words, the level monitor 115 is relatively away from a side where the bottom 112*b* is located. The level monitor 115 is electrically coupled to the controller 130 to monitor a liquid level of the first sterilization and cleaning liquid L1 in the first tank 112. When the level monitor 115 detects that the liquid level is lower than a predetermined level, the controller 130 may send a stop signal to the first atomizer 113, so as to stop the first atomizer 113 from atomizing the first sterilization and cleaning liquid L1, and simultaneously send a warning signal to the cloud server 150 through the wireless transmission module 144, so as to automatically or manually refill the first sterilization and cleaning liquid L1. For example, when a storage of the first sterilization and cleaning liquid L1 in the first tank 112 is not enough, the first sterilization and cleaning liquid L1 may be supplemented through an external opening (not shown) of the first tank 112. Alternatively, the first tank 112 with an insufficient storage of the first sterilization and cleaning liquid L1 is removed and replaced with a tank storing a certain amount of the sterilization and cleaning liquid for subsequent use. The invention does not intend to impose a limitation in this regard.

Moreover, the sterilization and cleaning system 100 of the escalator further includes a power supply module 160 that provides power to the first body 110, the controller 130, and the second body 140. For example, the power supply module 160 may be fixed between the first body 110 and the second body 140, or may be detachably disposed between the first body 110 and the second body 140. It should be noted that a position where the power supply module 160 is disposed may be adjusted based on the needs, and is not limited to the position between the first body 110 and the second body 140. More specifically, a power source of the power supply module 160 may be the commercial power or a battery. Here, the commercial power may be supplied from power provided for the escalator 10 to operate, for example. However, the invention is not limited thereto. Also, the battery is a solar cell, for example. Therefore, the sterilization and cleaning system 100 of the escalator may have a solar energy panel (not shown) adapted to receive ambient light for photovoltaic conversion. However, the invention is not limited thereto. Moreover, based on the needs, the battery may also be a storage battery or a chargeable battery.

In another embodiment, to improve the safety of people in public areas, an emergency button may be optionally disposed on the first body 110, the second body 140, or other external components, such that when there is an emergency, people in the public areas may push the button to notify relevant authorities (e.g., the police station or fire bureau).

As shown in FIG. 1, a security lock 145 may be installed in the second body 140, so as to lock the first body 110, the second body 140, and other external components. Here, the second body 140 and other external components are locked at a specific position to abut against a magnetic reed switch (not shown) or a micro switch (not shown), for example. Specifically, when the second body 140 and other external components are correctly configured at a locking position to abut against the magnetic reed switch (not shown) or the micro switch (not shown), the security lock 145 may function normally to lock the first body 110, the second body 140, and other external components. Alternatively, when the second body 140 and other external components do not abut against the magnetic reed switch (not shown) or the micro switch (not shown), the security lock 145 is unable to lock the first body 110, the second body 140, and other external components.

In general, the cloud server 150 of this embodiment is capable of monitoring operating states of the first body 110 and the second body 140. The operating states here refer to the traffic of people, the number of times that the person 20 installs the network app, the number of times that the person 20 retrieves the network app, the storage of the first sterilization and cleaning liquid L1, a locking state of the security lock 145, a power storage of the power supply module 160, and relevant data sensed by the monitor or sensor. Furthermore, another machine body, such as an advertisement display module, may be optionally disposed in the sterilization and cleaning system 100 of the escalator, and the cloud server 150 may also be configured to monitor a display mode of the advertisement display module and exert display control over the advertisement display module. However, the invention is not limited thereto.

Other embodiments are provided in the following for further descriptions. It should be noted that the reference numerals and a part of the contents in the previous embodiment are used in the following embodiments, in which identical reference numerals indicate identical or similar components, and repeated description of the same technical contents is omitted. For a detailed description of the omitted parts, reference can be found in the previous embodiment, and no repeated description is contained in the following embodiments.

Figure 5A:
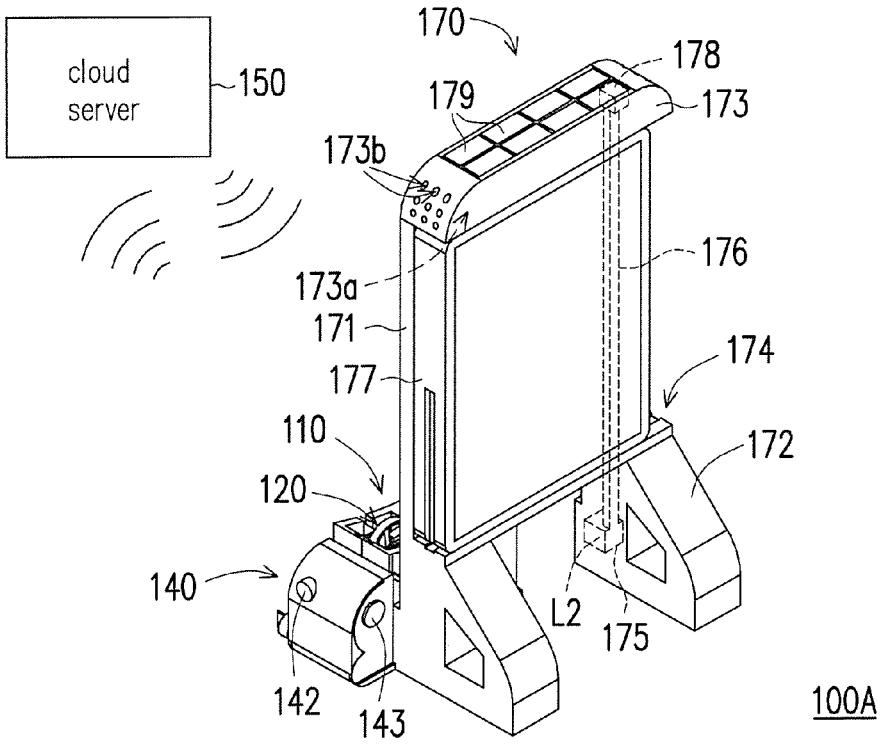
FIGS. 5A and 5B are schematic views illustrating a sterilization and cleaning system of an escalator according another embodiment of the invention.
Figure 5B:
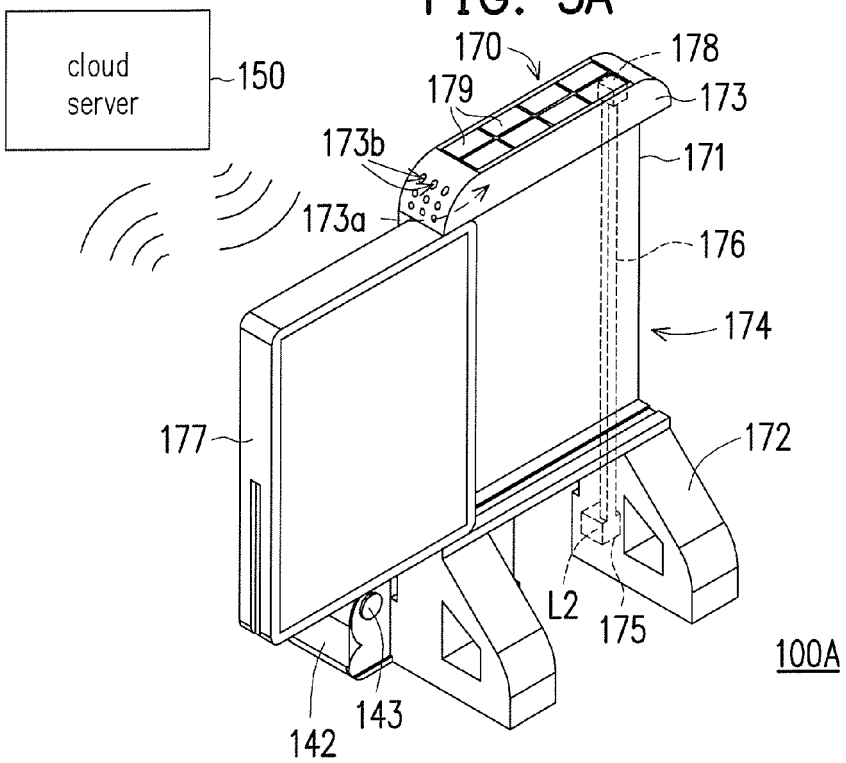
Figure 5C:
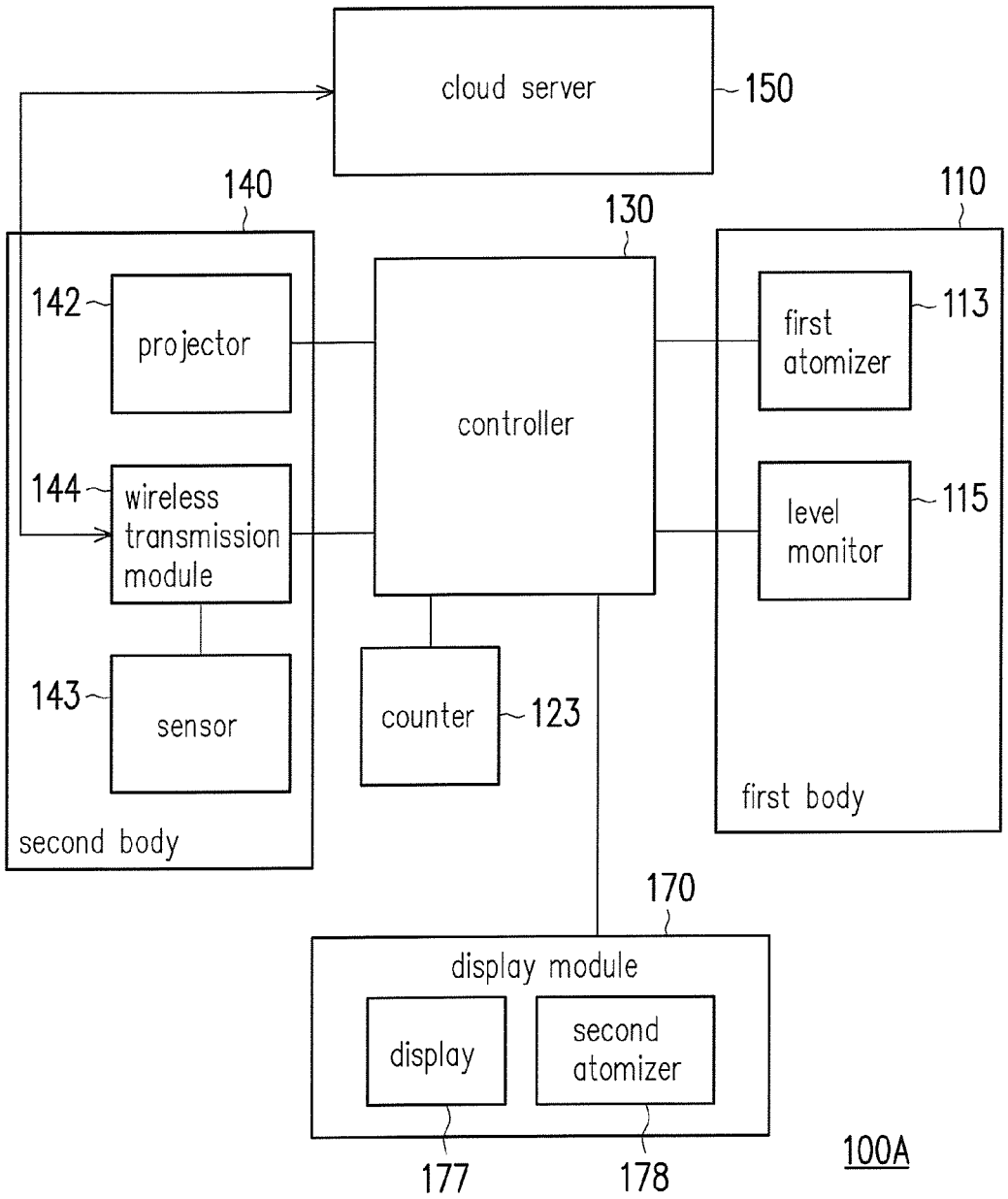
FIG. 5C is a schematic view illustrating connections of the sterilization and cleaning system of the escalator of FIG. 5A.

FIGS. 5A and 5B are schematic views illustrating a sterilization and cleaning system of an escalator according another embodiment of the invention. FIG. 5C is a schematic view illustrating connections of the sterilization and cleaning system of the escalator of FIG. 5A. Referring to FIGS. 5A to 5C, a sterilization and cleaning system 100A of an escalator is substantially similar to the sterilization and cleaning system 100 of the escalator of the previous embodiment, and a main difference therebetween is that the sterilization and cleaning system 100A of the escalator further includes a display module 170 disposed side by side with the first body 110 and the second body 140. More specifically, the display module 170 includes a frame body 171 and a display 177. In addition, the frame body 171 has a base 172, a top plate 173 opposite to the base 172, and a sliding track 174 between the base 172 and the top plate 173. The display 177 is slidably disposed in the sliding track 174, such that the display 177 is able to move back and forth in a state shown in FIGS. 5A and 5B.

The display 177 is electrically coupled to the controller 130. In addition, the cloud server 150 is adapted to transmit digital information to the wireless transmission module 144, and the digital information is transmitted to the controller 130 by the wireless transmission module 144, such that the controller 130 may control an image displayed on the display 177 based on the digital information. For example, the display 177 may display relevant advertisement information or public information in the form of video, image, or text, for example, for the person 20 passing through the passage 11 of the escalator 10 to view. Here, the power required for the display module 170 to operate is provided by the power supply module 160, for example. Alternatively, the display module 170 may have an independent power source. The invention does not intend to impose a limitation in this regard.

In another embodiment, the display module 177 may also be disposed on the frame body 171 through a positioning mechanism having six degrees of freedom of motions, for example, such that the display 177 may be optionally moved or rotated along X-axis, Y-axis, or Z-axis in a space with respect to the frame body 171. Therefore, a display plane of the display 177 may face different directions.

It should be noted that even though the wireless transmission module 144 is disposed in the second body 140 in this embodiment as an example, the invention is not limited thereto. For example, wireless transmission modules may be respectively disposed in the first body 110 and the display module 170 to communicate with the cloud server 150.

Moreover, the display module 170 further includes a second atomizer 178 disposed in a chamber 173*a* of the top plate 173 and electrically coupled to the controller 130. The frame body 171 further includes a second tank 175 located in the base 172 and storing a second sterilization and cleaning liquid L2 and a pipe 176 connecting the chamber 173*a* and the second tank 175. The pipe 176 is connected to the second atomizer 178 and is adapted to provide the second sterilization and cleaning liquid L2 to the second atomizer 178. Also, after the second atomizer 178 atomizes the second sterilization and cleaning liquid L2, the atomized second sterilization and cleaning liquid L2 is sprayed to the external environment via a plurality of openings 173*b* connected to the chamber 173*a*. In another embodiment, the second atomizer 178 may also be disposed on the frame body 171 (at the top plate 173, a back side of the sliding track 174, or the base 172, for example), and an opening may be provided on the frame body 171 as corresponding to the second atomizer 178, such that the second sterilization and cleaning liquid L2 atomized by the second atomizer 178 may be sprayed to the external environment through the opening.

Here, similar to the controlling of the first atomizer 113 of the previous embodiment, the counter 123 is adapted to transmit the operation distance of the handrail 14 to the controller 130, such that the controller 130 may control a period that the second atomizer 178 atomizes the second sterilization and cleaning liquid L2 and sprays the atomized second sterilization and cleaning liquid L2 via the openings 173*b* based on the operation distance. In other words, spraying of the atomized second sterilization and cleaning liquid L2 is not continuous without interruption. Instead, after each spraying (lasting several minutes, for example), the controller 130 may transmit a stop signal to the second atomizer 178, such that the second atomizer 178 may temporarily stop atomizing the second sterilization and cleaning liquid L2. Then, after the second atomizer 178 stops spraying the atomized second sterilization and cleaning liquid L2 and the operation distance calculated by the counter 123 reaches a predetermined value, the controller 130 may send a start signal to the second atomizer 178, such that the second atomizer 178 may perform the operation of atomizing the second sterilization and cleaning liquid L2 and spraying the atomized second sterilization and cleaning liquid L2 to the external environment via the openings 173*b* again.

Moreover, the sensor 143 is adapted to transmit the number of the person 20 passing through the passage 11 to the controller 130, such that the controller 130 may control the period that the second atomizer 178 atomizes the second sterilization and cleaning liquid L2 to spray the atomized second sterilization and cleaning liquid L2 to the external environment via the openings 173*b* based on the number of the person 20 passing through the passage 11. In other words, spraying of the atomized second sterilization and cleaning liquid L2 is not continuous without interruption. Instead, after each spraying (lasting several minutes, for example), the controller 130 may transmit a stop signal to the second atomizer 178, such that the second atomizer 178 may temporarily stop atomizing the second sterilization and cleaning liquid L2. Then, after the second atomizer 178 stops spraying the atomized second sterilization and cleaning liquid L2 and the number of the person 20 passing through the passage 11 reaches a predetermined value, the controller 130 may send a start signal to the second atomizer 178, such that the second atomizer 178 may perform the operation of atomizing the second sterilization and cleaning liquid L2 to spray the atomized second sterilization and cleaning liquid L2 to the external environment via the openings 173*b* again. It should be noted that in the display module 170, at least one solar energy panel 179 (a plurality of the solar energy panels 179 are shown in FIGS. 5A and 5B for an illustrative purpose) may be disposed on the top plate 173 of the frame body 171, so as to receive the ambient light for photovoltaic conversion. In another embodiment, the solar energy panel 179 may also be disposed at the back side of the sliding track 174, the base 172, or other suitable positions, and the position where the solar energy panel 172 is disposed may be adjusted based on the needs.

In other embodiments, the display module 170 may further include a storage module (not shown). In addition, the digital information sent by the cloud server 150 may be stored in a storage module (not shown). The digital information stored in the storage module (not shown) may be retrieved by the controller 130 and displayed on the display 177 when the advertisement information or public information is to be displayed on the display 177. Alternatively, an audio/video file, a video file, an image file, or a text file may be stored in the storage module (not shown) in advance in the storage module. The digital information stored in the storage module (not shown) may be retrieved by the controller 130 and displayed on the display 177 when the advertisement information or public information is to be displayed on the display 177.

In another embodiment, to improve the safety of people in public areas, an emergency button may be optionally disposed on the first body 110, the second body 140, the display module 170, or other external components, such that when there is an emergency, people in the public areas may push the button to notify relevant authorities (e.g., the police station or fire bureau). It should be noted that the emergency button may also be a virtual touch button displayed on the display 177 of the display module 170.

Figure 6A:
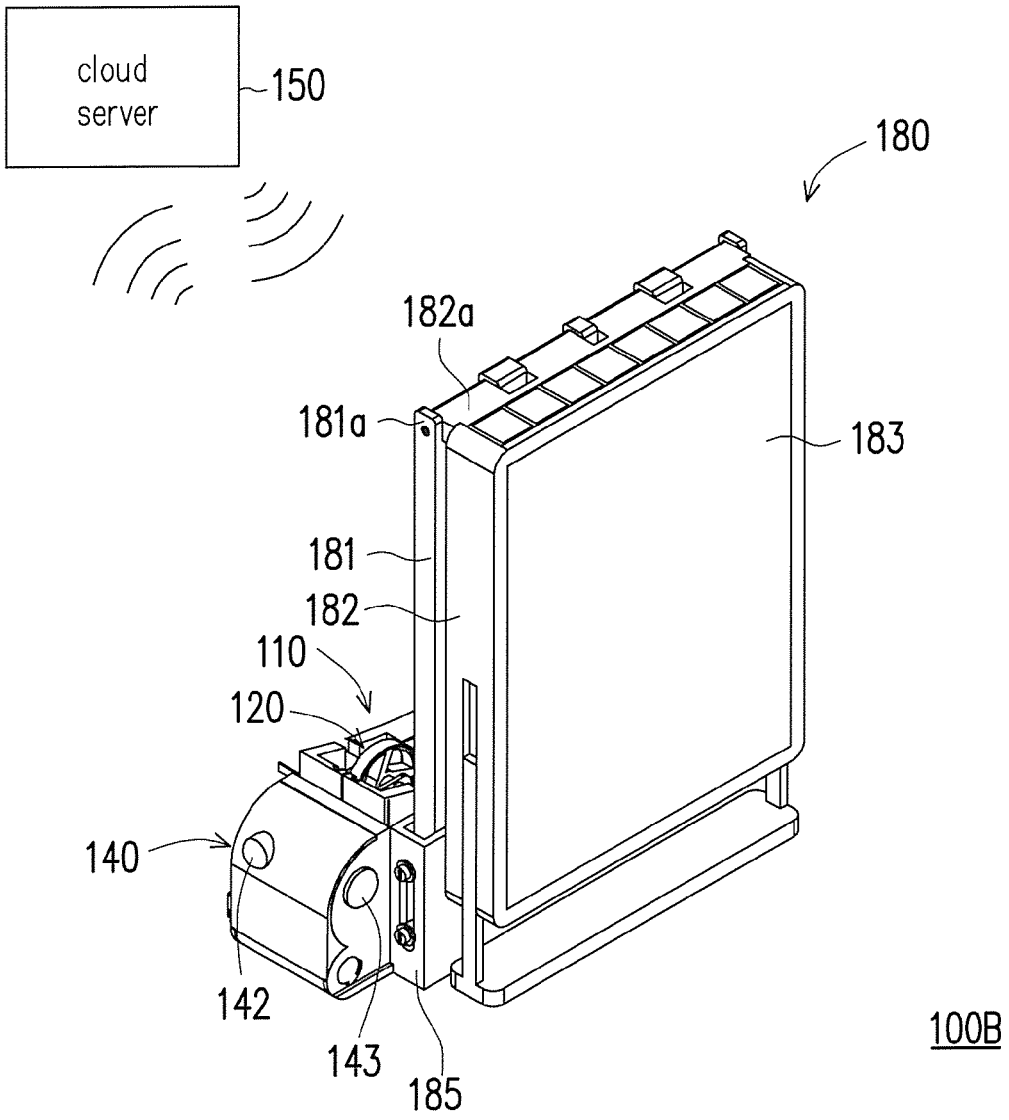
FIGS. 6A and 6B are schematic views illustrating a sterilization and cleaning system of an escalator according another embodiment of the invention.
Figure 6B:
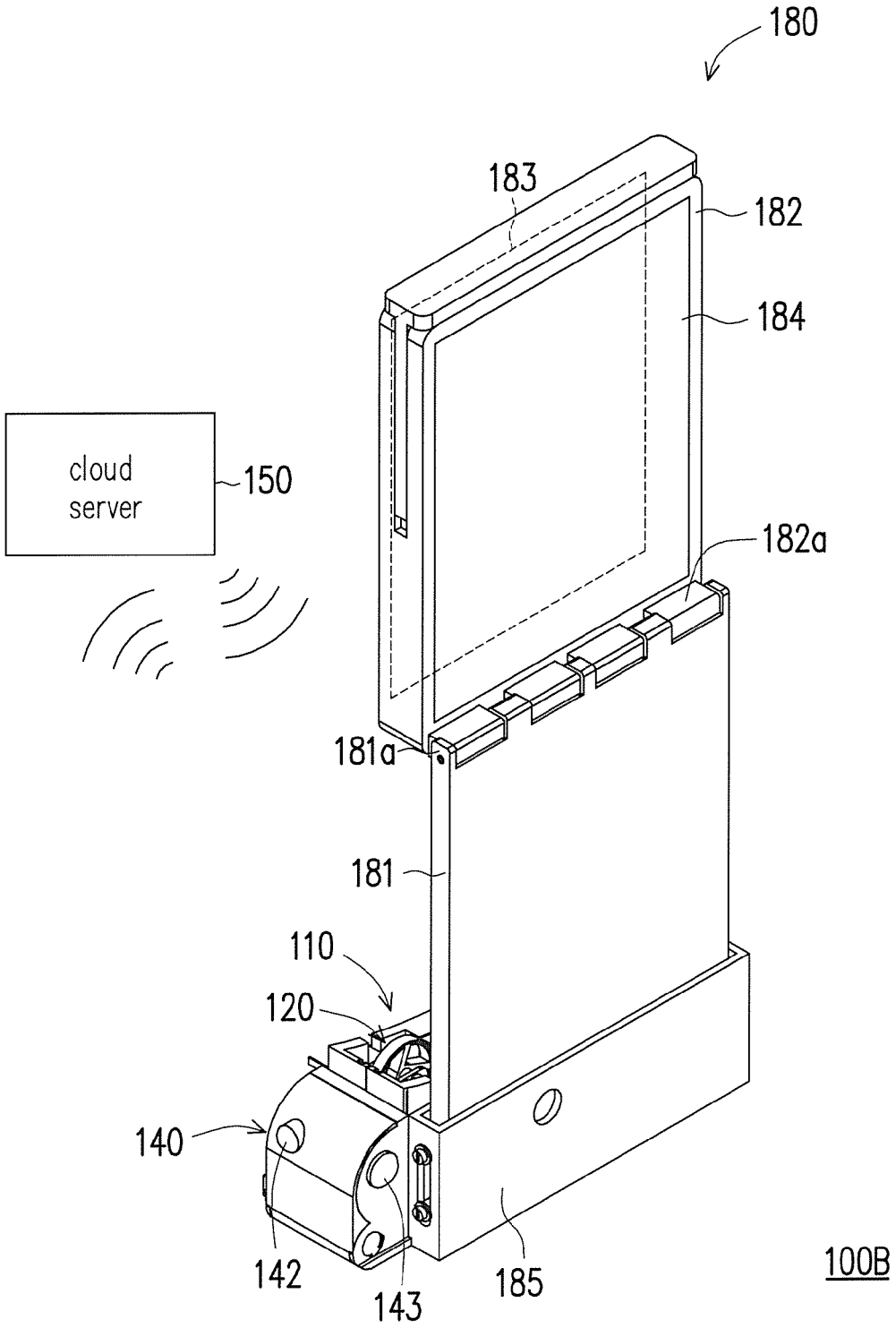
Figure 6C:
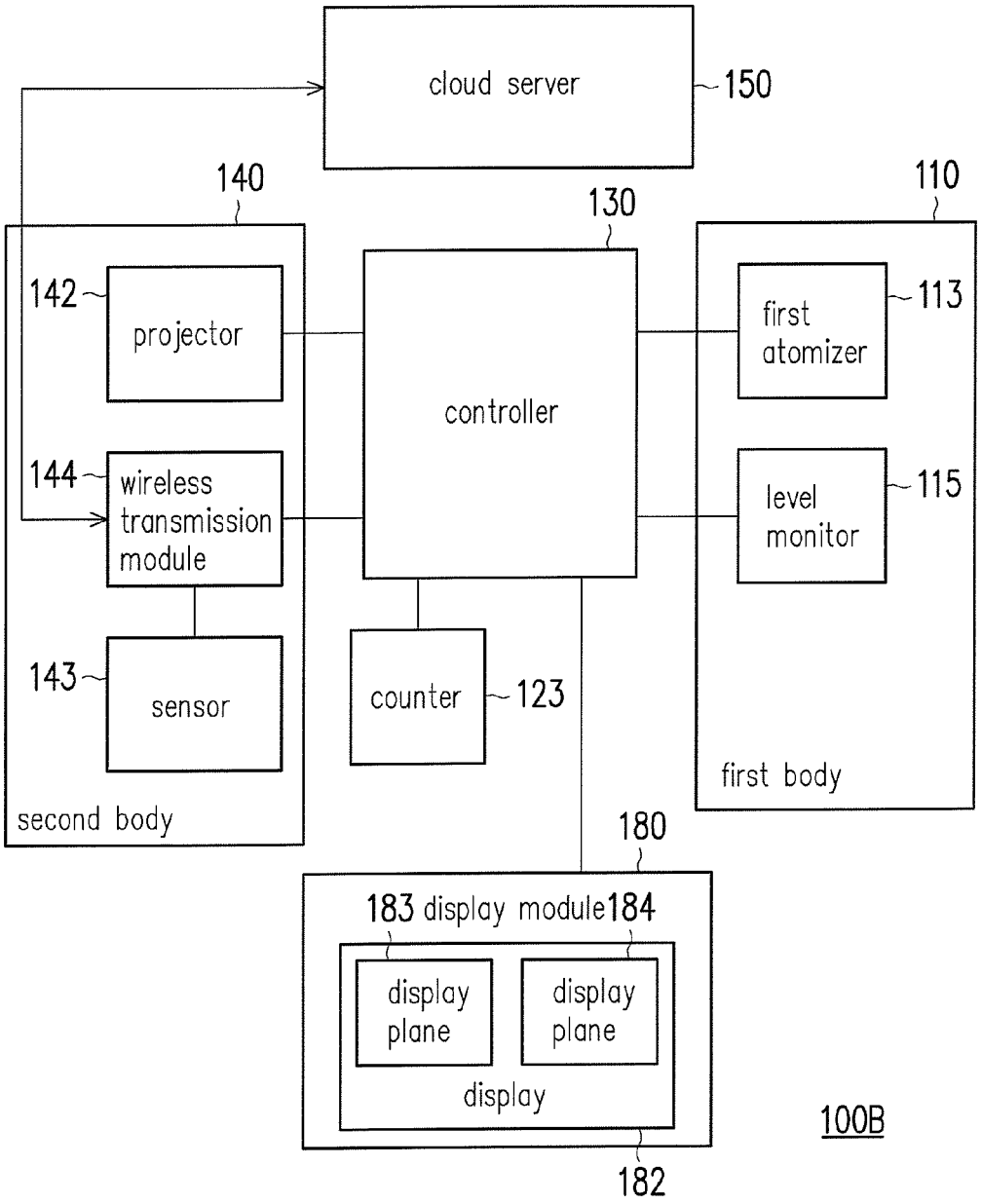
FIG. 6C is a schematic view illustrating connections of the sterilization and cleaning system of the escalator of FIG. 6A.

FIGS. 6A and 6B are schematic views illustrating a sterilization and cleaning system of an escalator according another embodiment of the invention. FIG. 6C is a schematic view illustrating connections of the sterilization and cleaning system of the escalator of FIG. 6A. Referring to FIGS. 6A to 6C, a sterilization and cleaning system 100B of an escalator is substantially similar to the sterilization and cleaning system 100 of the escalator of the previous embodiment, and a main difference therebetween is that the sterilization and cleaning system 100B of the escalator further includes a display module 180 disposed side by side with the first body 110 and the second body 140. More specifically, the display module 180 includes a base 185, a frame body 181, and a display 182. In addition, the frame body 181 is inserted into and connected to the base 185, for example, and has a top part 181*a* opposite to the base 185. The display 182 has a pivot part 182*a*. The display 182 is pivoted to the top part 181*a* by using the pivot part 182*a*, so as to rotate with respect to the frame body 181, as shown in FIGS. 6A and 6B.

Here, the display 182 is a dual side display, for example, and electrically coupled to the controller 130. The cloud server 150 is adapted to transmit digital information to the wireless transmission module 144, and the digital information is transmitted to the controller 130 by the wireless transmission module 144, such that the controller 130 may control an image displayed on the display 182 based on the digital information. For example, in the state shown in FIG. 6A, the display 182 only displays relevant advertisement information or public information in the form of video, image, or text, for example, only on a display plane 183 for the person 20 passing through the passage 11 of the escalator 10 to view. Also, in the state shown in FIG. 6B, another display plane 184 opposite to the display 183 may also display relevant advertisement information or public information in the form of video, image, or text, for example. Under such circumstance, the display plane 184 of the display 182 faces the passage 11 of the escalator 10, for example, and the display plane 183 faces a space other than the escalator 10. Thus, the people 20 passing around the escalator 10 are all able to view the advertisement information or public information displayed on the display plane 183 or 184. Here, the power required for the display module 180 to operate is provided by the power supply module 160, for example. Alternatively, the display module 180 may have an independent power source. The invention does not intend to impose a limitation in this regard.

In another embodiment, the display module 182 may also be disposed on the frame body 181 through a positioning mechanism having six degrees of freedom of motions, for example, such that the display 182 is able to move or rotate along X-axis, Y-axis, or Z-axis in a space with respect to the frame body 171. Therefore, the display planes of the display 182 may face different directions.

It should be noted that even though the wireless transmission module 144 is disposed in the second body 140 is this embodiment as an example, the invention is not limited thereto. For example, wireless transmission modules may be respectively disposed in the first body 110 and the display module 180 to communicate with the cloud server 150.

In other embodiments, the display module 180 may further include a storage module (not shown). In addition, the digital information sent by the cloud server 150 may be stored in a storage module (not shown). The digital information stored in the storage module (not shown) may be retrieved by the controller 130 and displayed on the display 182 when the advertisement information or public information is to be displayed on the display 182. Alternatively, an audio/video file, a video file, an image file, or a text file may be stored in the storage module (not shown) in advance in the storage module. The digital information stored in the storage module (not shown) may be retrieved by the controller 130 and displayed on the display 182 when the advertisement information or public information is to be displayed on the display 182.

Figure 7:
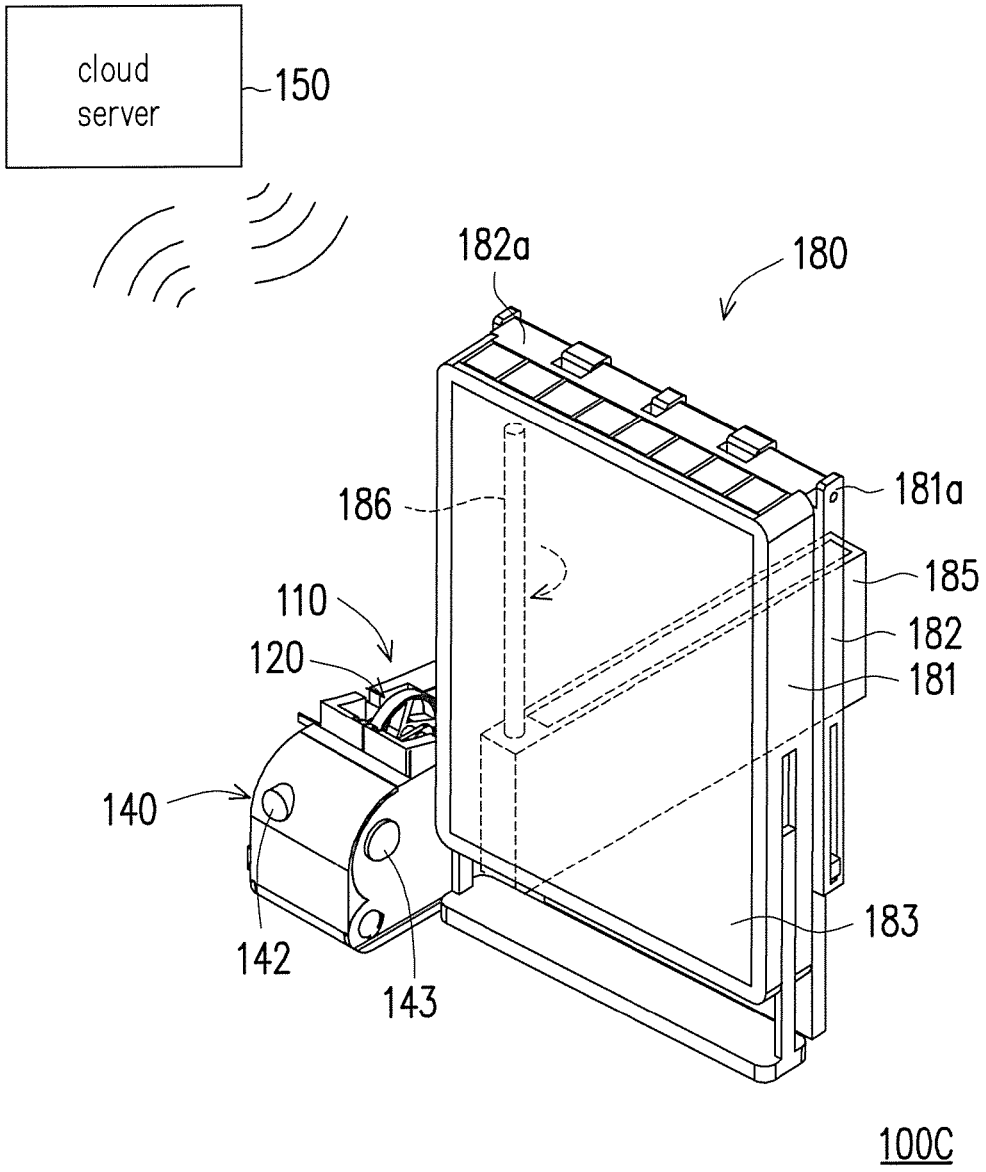
FIG. 7 is a schematic view illustrating a sterilization and cleaning system of an escalator according another embodiment of the invention.

FIG. 7 is a schematic view illustrating a sterilization and cleaning system of an escalator according another embodiment of the invention. Referring to FIG. 7, a sterilization and cleaning system 100C of an escalator is substantially similar to the sterilization and cleaning system 100B of the escalator of the previous embodiment, and a main difference therebetween is that the frame body 181 of the display module 180 the sterilization and cleaning system 100C of the escalator is adapted to rotate with respect to the base 185 by being pivoted to the base 185 through a pivot 186, for example, such that the display 182 disposed on the frame body 181 may display an image toward different directions.

In view of the foregoing, the embodiments of the invention provide the sterilization and cleaning system of the escalator including the first body, the counting wheel, the controller, the second body, and the cloud server. The cloud server is adapted to communicate with the wireless transmission module in the second body for two-way data transmission. More specifically, the first atomizer is disposed in the first body, and the controller controls the first atomizer to atomize the first sterilization and cleaning liquid in the first tank, such that the atomized first sterilization and cleaning liquid is sprayed to the handrail of the escalator, thereby automatically sterilizing and cleaning the handrail of the escalator. Furthermore, the cloud server is adapted to transmit digital information to the wireless transmission module, and the digital information is transmitted to the controller by the wireless transmission module, so that the controller may control the projection of the projector of the second body based on the digital information. For example, the projector may project relevant advertisement information or public information in the form of video, image, or text, for example, to the ground near the entrance or the exit of the passage of the escalator or to a wall, a ceiling, a projection billboard correspondingly disposed for people to view.

Moreover, the sensor also transmits the number of the person passing through the passage to the cloud server through the wireless transmission module for controlling and calculating the traffic of people. When the sensor senses that the person passes through the passage of the escalator, the sensor may notify the cloud server through the wireless transmission module, such that the cloud server may push a message to the mobile device (e.g., a smartphone or a tablet computer) of the person passing through the passage through the wireless transmission module for the person to view. For example, the message may be advertisement information or public information, and the control and calculation of the traffic of people may serve as an evaluation on an effect of the advertisement or propaganda.

It will be apparent to those skilled in the art that various modifications and variations can be made to the structure of the disclosure without departing from the scope or spirit of the disclosure. In view of the foregoing, it is intended that the disclosure cover modifications and variations of the disclosure provided they fall within the scope of the following claims and their equivalents.

What is claimed is:

1. A sterilization and cleaning system of an escalator, comprising:
- a first body, comprising:
  - a first tank, storing a first sterilization and cleaning liquid; and
  - a first atomizer, connected to the first tank and adapted to atomize the first sterilization and cleaning liquid in the first tank and spray the atomized first sterilization and cleaning liquid to a handrail of the escalator;
- a counting wheel, pivoted on the first body and abutting against the handrail, so as to synchronously rotate as the handrail operates;
- a controller, electrically coupled to the first atomizer;
- a second body, disposed side by side with the first body, wherein the second body comprises:

a projector, electrically coupled to the controller;

a sensor, electrically coupled to the controller and facing a passage of the escalator to sense a person passing through the passage; and a wireless transmission module, electrically coupled to the controller and the sensor; and a cloud server, adapted to communicate with the wireless transmission module.

2. The sterilization and cleaning system of the escalator as claimed in claim 1, wherein the first tank has an opening and a bottom opposite to the opening, the first atomizer comprises an atomizing nozzle and an absorber connected to the atomizing nozzle, the atomizing nozzle is disposed at the opening and electrically coupled to the controller, and the absorber extends from the opening toward the bottom to provide the first sterilization and cleaning liquid to the atomizing nozzle.

3. The sterilization and cleaning system of the escalator as claimed in claim 1, wherein the first body further comprises a level monitor, and the level monitor is electrically coupled to the controller and adapted to monitor a liquid level of the first sterilization and cleaning liquid in the first tank.

4. The sterilization and cleaning system of the escalator as claimed in claim 3, wherein when the level monitor detects that the liquid level is lower than a predetermined value, the controller stops the first atomizer from atomizing the first sterilization and cleaning liquid and sends a warning signal to the cloud server.

5. The sterilization and cleaning system of the escalator as claimed in claim 1, wherein the counting wheel comprises:

a shaft rod, pivoted on the first body;

a wheel, sleeved on the shaft rod and abutting against the handrail, so as to synchronously rotate as the handrail operates; and a counter, electrically coupled to the controller, wherein the counter is disposed corresponding to the wheel to calculate an operation distance of the handrail.

6. The sterilization and cleaning system of the escalator as claimed in claim 5, wherein the counter is adapted to transmit the operation distance of the handrail to the controller, such that the controller controls a period that the first atomizer atomizes the first sterilization and cleaning liquid and sprays the atomized first sterilization and cleaning liquid to the handrail of the escalator based on the operation distance.

7. The sterilization and cleaning system of the escalator as claimed in claim 1, wherein the sensor is adapted to transmit the number of the person passing through the passage to the controller, such that the controller controls a period that the first atomizer atomizes the first sterilization and cleaning liquid and sprays the atomized first sterilization and cleaning liquid to the handrail of the escalator based on the number of the person passing through the passage.

8. The sterilization and cleaning system of the escalator as claimed in claim 1, wherein the sensor is adapted to transmit the number of the person passing through the passage to the cloud server through the wireless transmission module.

9. The sterilization and cleaning system of the escalator as claimed in claim 1, wherein the sensor is adapted to notify the cloud server through the wireless transmission module when sensing that the person passes through the passage, such that the cloud server pushes a message to a mobile device of the person passing through the passage through the wireless transmission module.

10. The sterilization and cleaning system of the escalator as claimed in claim 1, wherein after the wireless transmission module establishes connection with a mobile device of the person passing through the passage, the cloud server is adapted to push a message to the mobile device of the person passing through the passage through the wireless transmission module.

11. The sterilization and cleaning system of the escalator as claimed in claim 1, wherein the cloud server is adapted to transmit digital information to the wireless transmission module and the digital information is transmitted to the controller by the wireless transmission module, such that the controller controls projection of the projector based on the digital information.

12. The sterilization and cleaning system of the escalator as claimed in claim 1, wherein a transmission of the wireless transmission module comprises infrared transmission, radio transmission, bluetooth transmission, or wireless fidelity transmission.

13. The sterilization and cleaning system of the escalator as claimed in claim 1, further comprising:

a power supply module, fixed between the first body and the second body and adapted to provide power to the first body, the controller, and the second body.

14. The sterilization and cleaning system of the escalator as claimed in claim 1, further comprising:

a power supply module, detachably disposed between the first body and the second body and adapted to provide power to the first body, the controller, and the second body.

15. The sterilization and cleaning system of the escalator as claimed in claim 5, further comprising a display module disposed side by side with the first body and the second body, wherein the display module comprises:

a frame body, having a base, a top plate opposite to the base, and a sliding track between the base and the top plate; and a display, slidably disposed in the sliding track, and electrically coupled to the controller, wherein the cloud server is adapted to transmit digital information to the wireless transmission module and the digital information is transmitted to the controller by the wireless transmission module, such that the controller controls an image displayed on the display based on the digital information.

16. The sterilization and cleaning system of the escalator as claimed in claim 15, wherein the display module further comprises a second atomizer disposed in a chamber of the top plate and electrically coupled to the controller, the frame body further comprises a second tank located at the base and storing a second sterilization and cleaning liquid and a pipe connecting the chamber and the second tank, wherein the pipe is connected to the second atomizer and adapted to provide the second sterilization and cleaning liquid to the second atomizer, such that the atomized second sterilization and cleaning liquid is sprayed to an external environment via a plurality of openings connected with the chamber after the second atomizer atomizes the second sterilization and cleaning liquid.

17. The sterilization and cleaning system of the escalator as claimed in claim 16, wherein the counter is adapted to transmit the operation distance of the handrail to the controller, such that the controller controls a period that the second atomizer atomizes the second sterilization and cleaning liquid and sprays the atomized second sterilization and cleaning liquid to the external environment via the openings based on the operation distance.

18. The sterilization and cleaning system of the escalator as claimed in claim 16, wherein the sensor is adapted to transmit the number of the person passing through the passage to the controller, such that the controller controls a period that the second atomizer atomizes the second sterilization and cleaning liquid and sprays the atomized second sterilization and cleaning liquid to the external environment via the openings based on the number of the person passing through the passage.

19. The sterilization and cleaning system of the escalator as claimed in claim 15, wherein the display module further comprises:

at least one solar energy panel, disposed at the top plate of the frame body.

20. The sterilization and cleaning system of the escalator as claimed in claim 1, further comprising a display module disposed side by side with the first body and the second body, wherein the display module comprises:

a base;

a frame body, inserted into or pivoted to the base, wherein the frame body has a top part opposite to the base; and a display, having a pivot part, wherein the display is pivoted to the top part by using the pivot part for rotating with respect to the frame body, the display is electrically coupled to the controller, and the cloud server is adapted to transmit digital information to the wireless transmission module and the digital information is transmitted to the controller by the wireless transmission module, such that the controller controls an image displayed on the display based on the digital information.

21. The sterilization and cleaning system of the escalator as claimed in claim 1, wherein the first body, the counting wheel, and the second body are embedded in a transport base of the escalator.

22. The sterilization and cleaning system of the escalator as claimed in claim 21, wherein the controller is embedded in the transport base of the escalator.

* * * * *